US012312821B2

(12) United States Patent
Mackintosh et al.

(10) Patent No.: US 12,312,821 B2
(45) Date of Patent: May 27, 2025

(54) ADAPTABLE, TEMPORARY LANDSCAPE PROTECTION STRUCTURE

(71) Applicants: Eric Mackintosh, Tyler, TX (US); Heath Hicks, Tyler, TX (US)

(72) Inventors: Eric Mackintosh, Tyler, TX (US); Heath Hicks, Tyler, TX (US)

( * ) Notice: Subject to any disclaimer, the term of this patent is extended or adjusted under 35 U.S.C. 154(b) by 199 days.

(21) Appl. No.: 18/093,490

(22) Filed: Jan. 5, 2023

(65) Prior Publication Data

US 2023/0212867 A1 Jul. 6, 2023

Related U.S. Application Data

(60) Provisional application No. 63/296,687, filed on Jan. 5, 2022.

(51) Int. Cl.
*E04G 21/30* (2006.01)

(52) U.S. Cl.
CPC ..... *E04G 21/30* (2013.01)

(58) Field of Classification Search
CPC ..... E05F 7/04
See application file for complete search history.

(56) References Cited

U.S. PATENT DOCUMENTS 199,353 A * 1/1878 Clark ..... A01G 9/12 256/72
4,730,423 A * 3/1988 Hughes ..... E04H 15/58 52/27
5,083,396 A * 1/1992 Traut ..... A01G 13/10 47/31
5,226,264 A * 7/1993 Walters ..... E04H 1/1238 52/63
5,451,445 A * 9/1995 Wang ..... A01G 13/0206 428/137
6,618,988 B2 * 9/2003 Williams ..... A01G 9/16 47/17
6,625,924 B2 * 9/2003 Lundgren ..... A01G 13/0231 47/29.6
7,017,299 B1 * 3/2006 Speed ..... A01G 9/12 47/21.1

(Continued)

OTHER PUBLICATIONS

Barth,S., A Guide to Protecting Your Garden During Roof Installation, https://barthroofing.com/blog/roofing/a-guide-to-protecting-your-garde . . . , Oct. 12, 2021, Webpage accessed Nov. 30, 2022, Barth Roofing Co., 3 pages.

JL Roofing & Siding, a Homeowners Guide to Protecting Your Outdoor Spaces During Roofing Projects, https://www.jlroofingandsiding.com/a-homeowners-quide-to-protecting-your-outdoor-spaces-during-roofing-projects/, 2019, Webpage accessed Nov. 30, 2022, 2 pages.

(Continued)

*Primary Examiner* — Joshua K Ihezie
(74) *Attorney, Agent, or Firm* — Standley Law Group LLP; F. Michael Speed; Adam J. Smith

(57) ABSTRACT

Systems and methods for providing adaptable, reusable, temporary landscape protection at job sites are provided. Temporary structures are constructed which extend over the landscape features when installed. Protective cloths are placed over the temporary structures while work is performed and are subsequently removed. The temporary structures are deconstructed for reconstruction in different form at different job sites to protect different landscape features. The temporary structures may be of various size and shape, specific to the landscape features.

17 Claims, 20 Drawing Sheets

(56) References Cited

U.S. PATENT DOCUMENTS

| | | | | |
|---|---|---|---|---|
| 7,562,453 | B1 * | 7/2009 | Benner | E04H 17/004 256/11 |
| 9,181,723 | B2 * | 11/2015 | Schaefer | E04H 15/44 |
| 10,660,276 | B1 * | 5/2020 | Harris | A01G 13/0206 |
| 10,724,246 | B1 | 7/2020 | Hicks | |
| 10,980,191 | B2 * | 4/2021 | Lysak | A01G 13/0206 |
| 11,226,121 | B1 * | 1/2022 | Hornbacher | F24F 1/58 |
| 11,602,103 | B2 * | 3/2023 | Carlson | A01G 9/12 |
| 2002/0046484 | A1 * | 4/2002 | Lundgren | A01G 13/0231 47/29.6 |
| 2005/0022853 | A1 * | 2/2005 | Scissom | F24F 1/58 135/156 |
| 2006/0185708 | A1 * | 8/2006 | Sylvestre | A01G 13/043 47/20.1 |
| 2007/0246464 | A1 * | 10/2007 | Horcher, III | E04H 15/003 220/9.4 |
| 2007/0266625 | A1 * | 11/2007 | Markis | A01G 13/10 47/29.6 |
| 2012/0090230 | A1 * | 4/2012 | Frost | A01G 9/12 47/45 |
| 2017/0145606 | A1 * | 5/2017 | Toye | D04B 21/10 |
| 2017/0238478 | A1 | 8/2017 | Brough | |
| 2018/0177167 | A1 * | 6/2018 | Topping | A01G 22/60 |
| 2018/0310491 | A1 * | 11/2018 | Cunial | A01G 13/10 |
| 2019/0059240 | A1 * | 2/2019 | Scott | A01G 9/022 |
| 2022/0312693 | A1 * | 10/2022 | Aiken | A01G 17/06 |

OTHER PUBLICATIONS

Gardeners Supply Company, Cedar A-Frame Shrub Guards, https://www.gardeners.com/buy/cedar-scrub-guard/8610313.html, Webpage accessed Nov. 28, 2022, 2 pages.

Able Roofing, How to Prepare for a Roof Replacements, https://www.ableroof.com/blog/how-to-prepare-for-a-roof-replacement/, Mar. 24, 2021, Webpage accessed Nov. 28, 2022, 3 pages.

Restoration Roofing, How to Protect Your Landscaping During a New Roof Installation, https://www.restorationroofing.com/how-to-protect-your-landscaping-a-new-roof-installation/, 2022, Webpage accessed Nov. 28, 2022, 3 pages.

Gardeners Supply Company, Shade Kit 4'×8' for Gardens or Sandboxes Gardener's Supply, https://www.gardeners.com/buy/shade-kit-4-x-8/8598156.html, Webpage accessed Nov. 28, 2022, 4 pages.

Gebhart, B., Useful Tips to Protect Your Landscape During a Job, https://www.thomasroofing.net/useful-tips-to-protect-your-landscape-during-a-roofing-job/, Feb. 23, 2022, Webpage accessed Nov. 28, 2022, The Thomas Roofing Company, Inc. 2 pages.

Amazon, Uygalaxy Garden Mesh Netting Kit, Mini Greenhouse Kit to Build Tunnel Hoops + Film + Plant Covers (Freeze Protection) + Mesh Netting + Support Stakes All Season for Outdoors, Tomato,Raised Bed Nursery Patio, Lawn & Garden, https://www.amazon.com/UYGALAXY-Greenhouse-Protection-Netting-Kit/, first date available Aug. 20, 2021, Webpage accessed Nov. 28, 2022, 7 pages.

* cited by examiner

ADAPTABLE, TEMPORARY LANDSCAPE PROTECTION STRUCTURE

CROSS-REFERENCE TO RELATED APPLICATIONS

This application claims the benefit of U.S. provisional patent application Ser. No. 63/296,687 filed Jan. 5, 2022, the disclosures of which are hereby incorporated by reference as if fully restated herein.

TECHNICAL FIELD

Exemplary embodiments relate generally to structures for protecting landscape features, such as plants and other foliage, on a temporary basis from debris, such as falling debris during a roofing construction project.

BACKGROUND AND SUMMARY OF THE INVENTION

It is common for homeowners or other individuals to install landscaping around a home or other structure. Often times, these landscaping features are relatively sensitive and may include, for example without limitation, flowers, bushes, fountains, decorative art objects, garden beds, flower beds, combinations thereof, or the like. When various construction projects are performed on the structure, these landscape features may be damaged. For example, without limitation, during roofing work, debris may purposefully be released from, or accidentally fall from, the roof to the ground. For example, old or damaged shingles and other materials may be allowed to slide off an existing roof during removal for subsequent replacement. These debris may fall onto sensitive plants and other landscape features causing damage and resulting in unhappy customers, replacement costs, or the like. Placing tarps or other cloth directly over such landscape features may provide insufficient protection. Existing debris collection chutes and tarps, such as those described in U.S. Pat. No. 10,724,246 issued Jul. 28, 2020 entitled ROOFING DEBRIS COLLECTION APPARATUS (the "'246 Patent"), may aid in protecting such landscape features. However, additional protection may be required in certain circumstance, such as for particularly sensitive or important landscape features, where particularly heavy debris may be experienced, where larger landscape features need protected, and/or where building structure and/or landscape features otherwise require. Leaning wood panels against a building provides limited protection and the panels are generally difficult to transport, among other drawbacks. Custom wooden structures are time consuming and expensive to build and tear down, among other drawbacks. Therefore, what is needed is an adaptable, temporary landscape protection structure.

An adaptable, temporary landscape protection structure is provided. Various members may be removably connected to connectors to define various size, shape, number, and/or type of structures. Alternatively, or additionally, at least some of the structures, or components thereof, may be integrally formed. Some or all of the members may be configured for telescoping or other movement to further define the size and/or shape of the structures. The structures may be erected for placement over one or more landscape features, such as on a temporary basis while construction work is performed. A protective cloth (e.g., tarp, netting, or the like) and/or covering (e.g., panel, plate, or the like) may be placed atop some or all of the structure(s) to protect the landscape features, such as from falling debris during work performed at the site. The structure(s) may be deconstructed for storage and/or movement to another site or another landscape feature at the same site. The structures may be fully customized or formed into one or more predetermined configurations. The structure(s) and/or protective cloth and/or covering may serve to absorb and/or transfer forces of falling debris away from the landscaping. The structure(s) and/or protective tarp and/or covering may provide sufficient protection while also allowing adequate airflow to keep landscape features relatively cool, which may be important in particularly hot working environments. The freestanding nature of the structure(s) may also reduce or eliminate risk of damage to the structure itself. The structure(s) may be used by themselves and/or in combination with some or all of the components shown and/or described in the '246 Patent.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
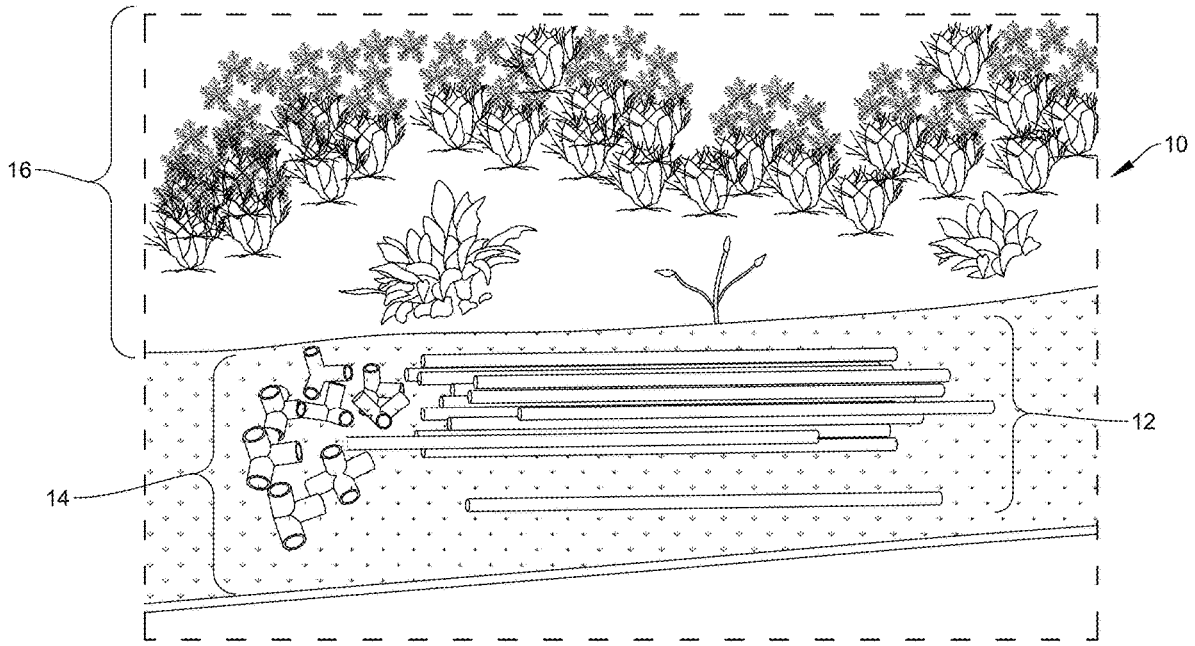
FIG. 1 is perspective view of a number of constituent components for an exemplary temporary, adaptable landscape protection structure in a disassembled state.

FIG. 1 illustrates constituent components for an exemplary temporary, adaptable landscape protection structure (hereinafter also the "structure") 10 in a disassembled state. The structure 10 may comprise a number of members 12 and connectors 14, in exemplary embodiments. Each of the members 12 may comprise poles. At least some of the members 12 may be rigid, straight-line members, though such is not required. At least some of the members 12 may comprise cylindrical, or substantially cylindrical shapes, though any shape may be utilized, such as but not limited to cuboids. The members 12 may comprise one or more polymers, metals, fiberglass, combinations thereof, or the like.

At least some of the connectors 14 may be configured to receive one or more of the members 12. The connectors 14 may be configured to removably receive the members 12, such as but not limited to, in a friction fit, snap fit, or the like. For example, without limitation, the connectors 14 may comprise recesses configured to receive a portion of one of the members 12, such as in a snug, friction fit that is sufficient to temporarily secure the member 12 within the connector 14 and allow manual securement and removal but prevent or reduce accidental dislodging. Buttons, latches, levers, combinations thereof, or the like, some or all of which may be biased or spring loaded, alternatively or additionally, may be provided at the members 12 and/or connectors 14 to selectively secure the member(s) 12 with the connector(s) 14. At least some of the connectors 14 may be spherical, or substantially spherical, in shape, though any shape may be utilized, such as but not limited to partial spheres, cuboids, triangles, domes, pyramids, or the like. The connectors 14 may comprise one or more polymers, metals, fiberglass, combinations thereof, or the like. In exemplary embodiments, each of the connectors 14 are configured to interchangeable receive any of the member 12, though such is not required.

In exemplary embodiments, each of the connectors 14 are configured to receive a plurality of the members 12, such as at various relative positions to define various shapes. Some of the connectors 14 may be configured to receive a plurality of the members 12 at different ones of the various relative positions. For example, without limitation, different size, shape, configuration, and/or number of the connectors 14 and/or members 12 may be provided and interconnected to make various size, shape, configuration, and/or number of structures 10. In this manner, the structure 10 may vary in size, shape, or configuration in an adaptable manner to create a structure 10 suitable to protect various landscape features 16.

A distal end of some or all of the members 12 may comprise a spike shape or other feature for mating with a ground surface, such as by insertion into the ground. Alternatively, or additionally, the distal end of some or all of the members 12 may comprise feet or other stabilizing elements, such as for resting on the ground surface to provide stability to the structure 10. In exemplary embodiments, some or all of the members 12 may be configured to removably and interchangeable receive spike shaped ends or feet/stabilizing ends.

In exemplary embodiments, some or all of the members 12 may be configured for telescoping, hinging, or other movement. This may permit adjustment for height, size, shape, combinations thereof, or the like of the members 12 and thus the assembled structure(s) 10. This may, alternatively or additionally, permit for adaptation of the structure 10 to uneven ground surfaces.

The members 12 may be removably connected to the connectors 14 or may be integrally formed therewith.

Figure 2:
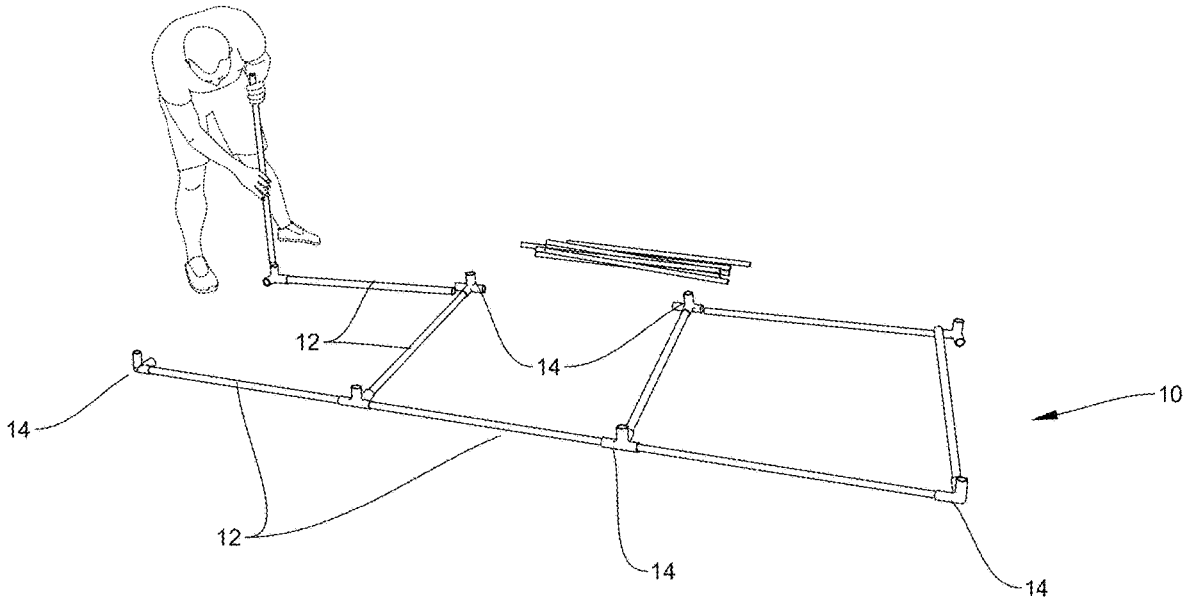
FIG. 2 is a perspective view of the temporary, adaptable landscape protection structure of FIG. 1 in a partially assembled state.

FIG. 2 illustrates an exemplary embodiment of the structure 10 in a partially assembled state. The connectors 14 and/or members 12 may be configured to permit quick assembly of the structure 10 into various sizes and shapes to protect a variety of landscape features 16. This may, for example, permit a user to quickly assemble a structure 10 at a jobsite to substantially or wholly cover some or all landscape features 16, which may vary in size, shape, and type from one job site to another. The structure 10 may subsequently be fully or partially disassembled for easy transportation to a different job site or another area of the same job site to create another structure 10 of the same or different size, shape, number, and/or configuration as needed.

Figure 3:
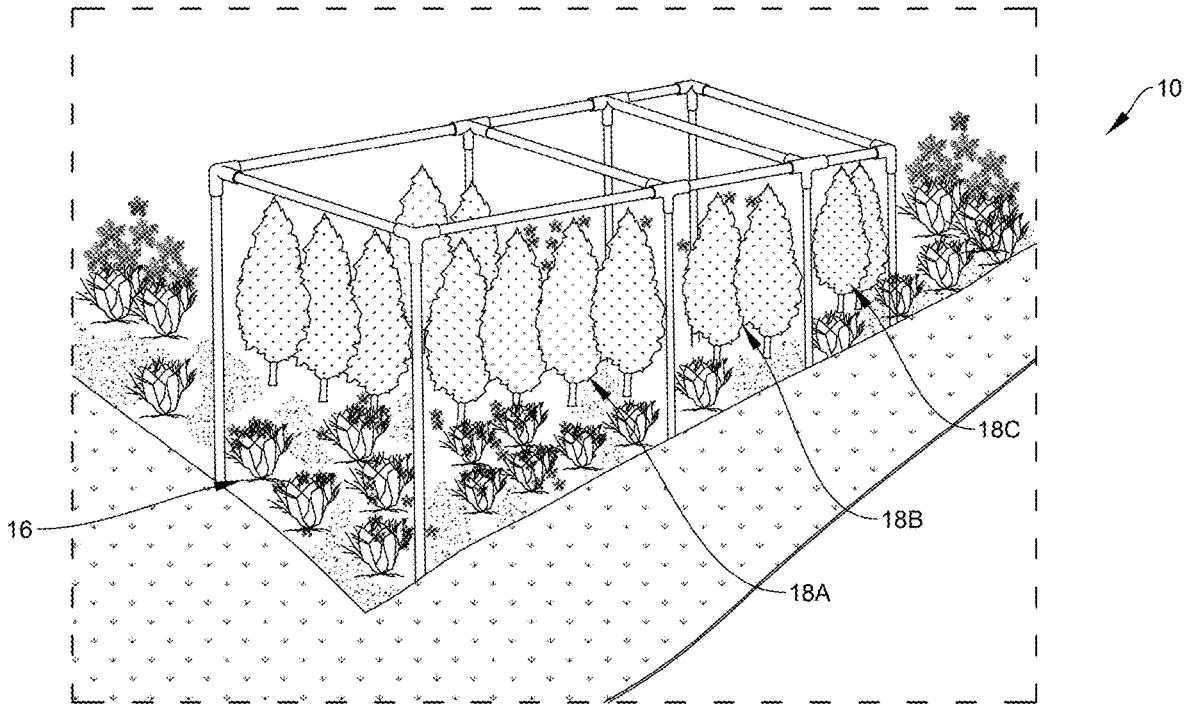
FIG. 3 is a perspective view of the temporary, adaptable landscape protection structure of FIG. 1 in an assembled state.

FIG. 3 illustrates the structure 10 in a partially assembled state. The structure 10 may comprise a series of cuboid, or substantially cuboid, shaped spaces 18A-18C. The structure 10 may be erected or placed overtop some or all of the landscape features 16.

Figure 4:
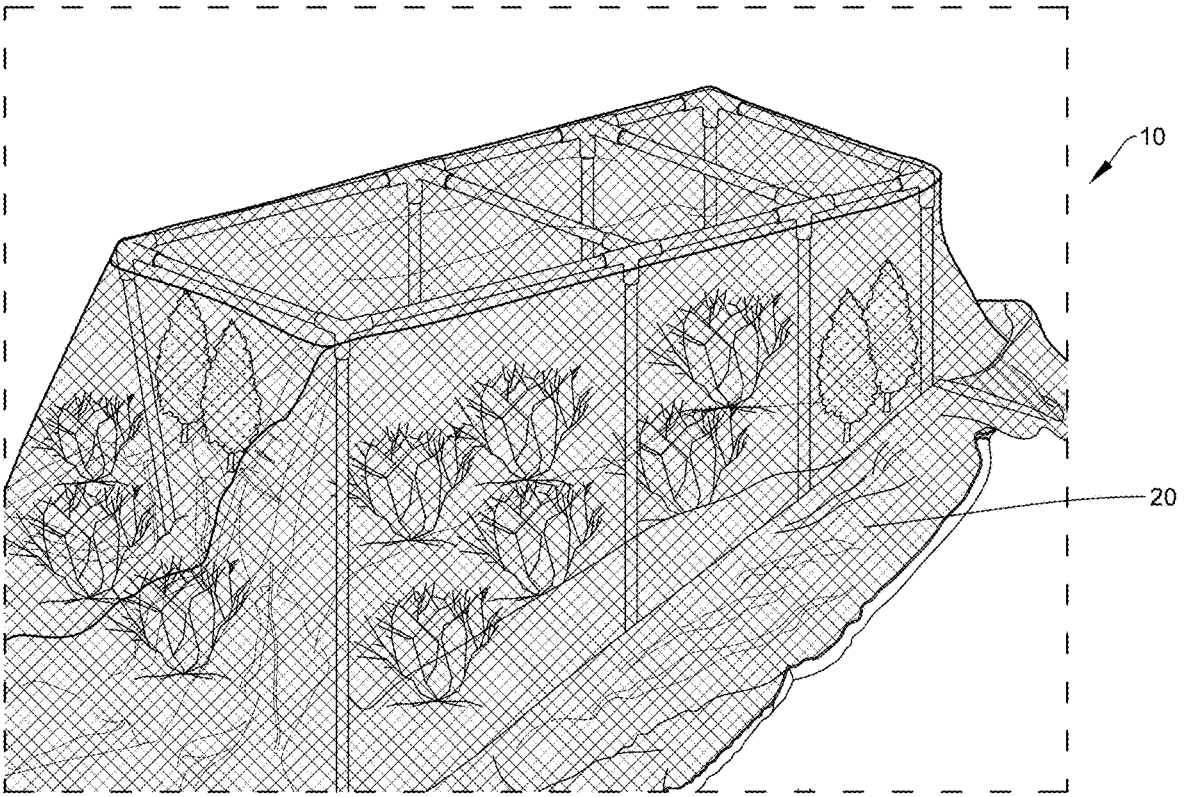
FIG. 4 is a perspective view of the temporary, adaptable landscape protection structure of FIG. 3 with an exemplary protective cloth installed.
Figure 5:
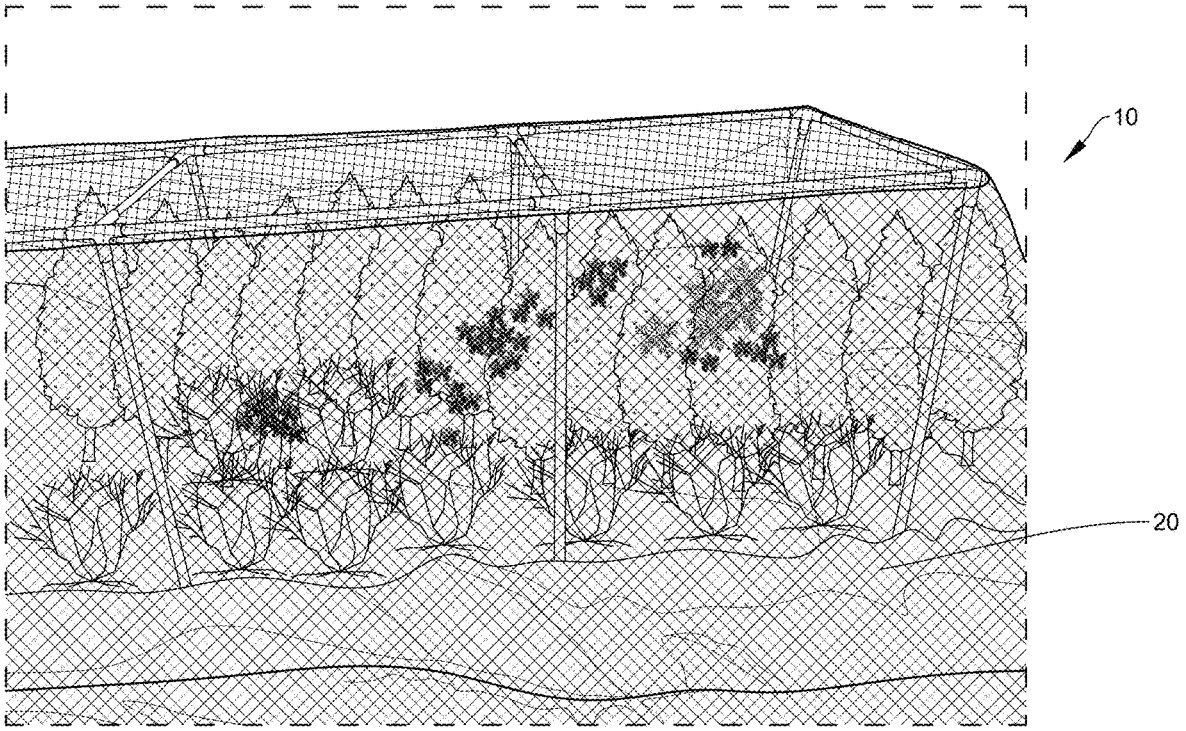
FIG. 5 is a detailed perspective view of the temporary, adaptable landscape protective structure of FIG. 4.

FIG. 4 and FIG. 5 illustrate the structure 10 with an exemplary protective cloth 20 installed. The protective cloth 20 may comprise a mesh, netting, fabric, tarp, combinations thereof, or the like. Some or all of the protective cloth 20 may comprise holes configured to permit air to circulate and mixed shade/sun coverage while also preventing debris beyond a predetermined size from traveling therebeyond, though such is not required. Such holes may be, for example without limitation, approximately 1 cm in diameter, though any size, shape, number, and/or type of holes of the same of different type provided in any pattern or randomly may be utilized. This may assist in preserving plants, flowers, and other landscape features 16 while covered, such as over a period of hours or days while work is completed. Alternatively, or additionally, some or all of the protective cloth 20 may be configured to provide a substantial or complete liquid barrier. Regardless, the protective cloth 20 may be configured to prevent common roofing debris, such as but not limited to, shingles, nails, screws, ferrules, flashing, lumber, combinations thereof, or the like from passing therebeyond in exemplary embodiments. The protective cloth 20 may comprise canvas, fabric, polymer, cotton, polyester, nylon, polypropylene, polyethylene, combinations thereof, or the like. The protective cloth 20 may be draped over some or all of the structure. The protective cloth 20 may be staked to the ground, secured by placement of heavy objects thereon, tied to the structure 10 (directly or by rope, zip-ties, bands, or the like) or otherwise fully or partially secured to the structure 10 such as to prevent movement, such as from wind, bumps, and/or to completely or fully arrest falling objects or other debris. The protective cloth 20 may be placed atop some or all of the structure 10, including over the various spaces 18A-C defined by the structure, to form an upper surface.

Some or all of the connectors 14 and/or members 12 may comprise fasteners, hooks, protrusions, recesses, straps, buttons, latches, relatively high friction surfaces, combinations thereof, or the like for mating with the protective cloth 20 in exemplary embodiments. The protective cloth 20 may comprise corresponding fasteners, hooks, protrusions, straps, buttons, relatively high friction surfaces, combinations thereof, or the like for mating with the connectors 14 and/or members 12.

Some or all of the connectors 14 may provide multiple connection options or points for the members 12. For example, without limitation, the connectors 14 may each comprise two, three, four, five, six, etc. connection points for two members 12 provided in various arrangements and/or of various type so that the structure 10 may be adapted to different configurations. Alternatively, or additionally, the connection points themselves may be moveable or adaptable, such as but not limited to, but hinging connection.

Figure 6:
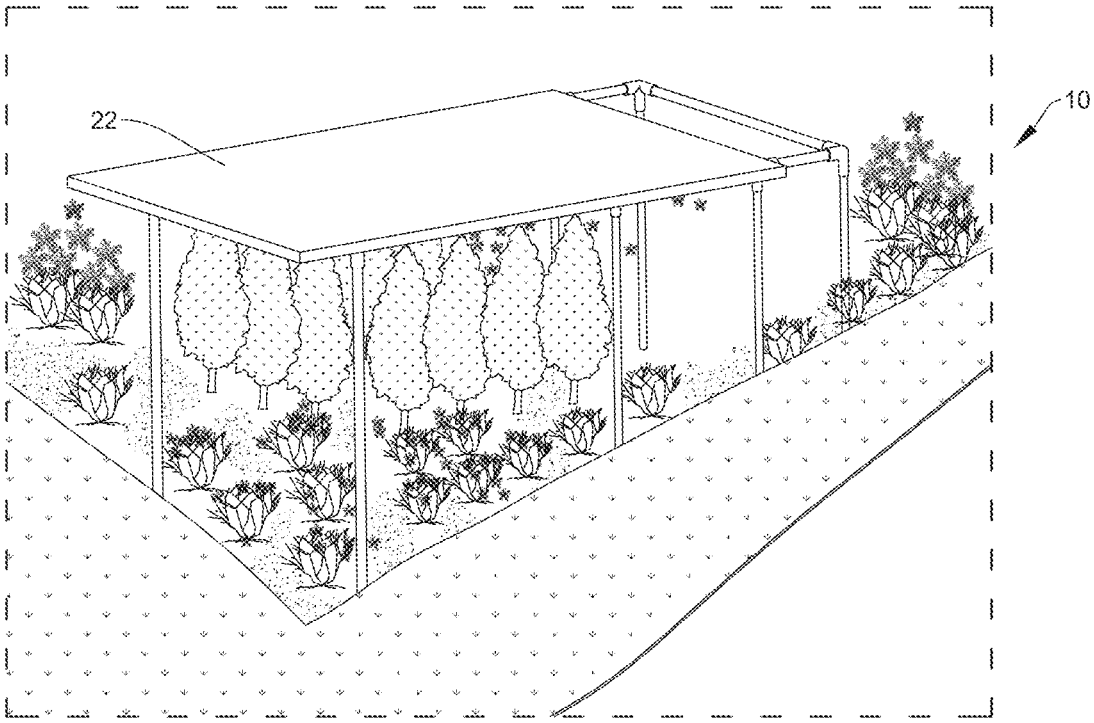
FIG. 6 is a perspective view of the temporary, adaptable landscape protection structure of FIG. 4 with an exemplary protective covering installed.

FIG. 6 illustrates the structure 10 with an exemplary protective covering 22 installed. The protective covering 22 may comprise one or more plates, members, rigid surfaces, combinations thereof, or the like. In exemplary embodiments, the protective covering 22 may comprise one or more sheets of plywood. The protective covering 22 may be placed atop some or all of the structure 10, including adopt the various spaces 18A-C defined by the structure, to form an upper surface or surfaces. The protective covering 22 may be sufficiently strong and/or rigid to partially or fully arrest falling objects or other debris, such as but not limited to, common roofing materials including but not limited to, shingles, nails, screws, ferrules, flashing, lumber, combinations thereof, or the like. The covering 22 may be placed solely at a top surface of the structure 10 in exemplary embodiments, to shade the landscape features 16 while permitting adequate airflow.

Some or all of the connectors 14 and/or members 12 may comprise fasteners, hooks, protrusions, recesses, straps, buttons, latches, relatively high friction surfaces, combinations thereof, or the like for mating with the protective covering 22 in exemplary embodiments. The protective covering 22 may comprise corresponding fasteners, hooks, protrusions, straps, buttons, relatively high friction surfaces, combinations thereof, or the like for mating with the connectors 14 and/or members 12.

The protective covering 22 may be used instead of the protective cloth 20 or in combination therewith.

Figure 7:
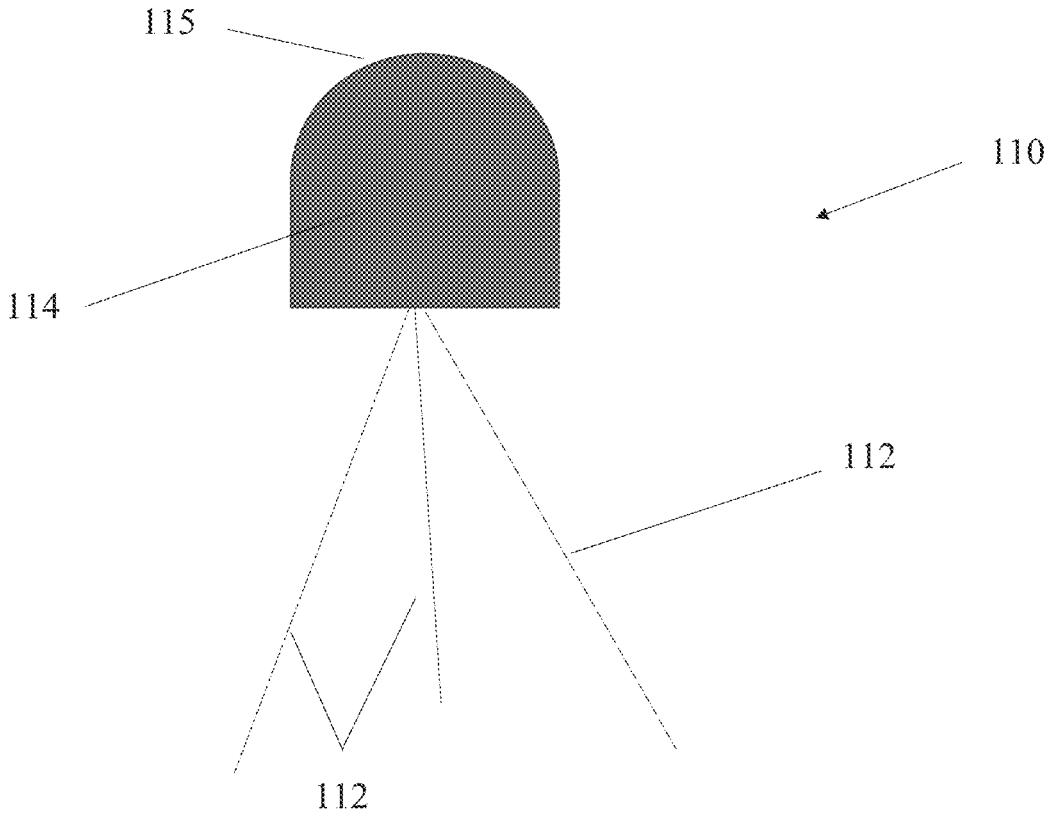
FIG. 7 is a side view of another exemplary temporary, adaptable landscape protection structure.

FIG. 7 illustrates another exemplary structure 110. Similar components may be numbered similarly but increased by one hundred (e.g., 10 to 110). A plurality of members 112 may be connected to a connector 114. In exemplary embodiments, the members 112 may be formed into a substantially tri-pod shape when connected to the connector 114. The members 112 may be removably connected to the connector 114 or integrally formed therewith. The connector 114, in exemplary embodiments without limitation, may comprise a dome shape or otherwise comprise a curved upper surface 115. The upper surface 115 may comprise a relatively high friction material, such as but not limited to rubber, to provide traction to the protective cloth 20 and/or protective covering 22, which may be placed thereatop.

In exemplary embodiments, some or all of the members 112 may be configured for telescoping, hinging, or other movement. For example, without limitation, some or all of the members 112 may be configured for securement at various angles relative to one another to create a wider or smaller footprint. Alternatively, or additionally, some or all of the members 112 may be configured for telescoping movement to adjust a height of the structure 110.

The structure 110 may be placed to extend coverage of the protective cloth 20 and/or protective covering 22, such as protect a particularly sensitive landscape feature 16 (e.g., flower or other plant).

Figure 8:
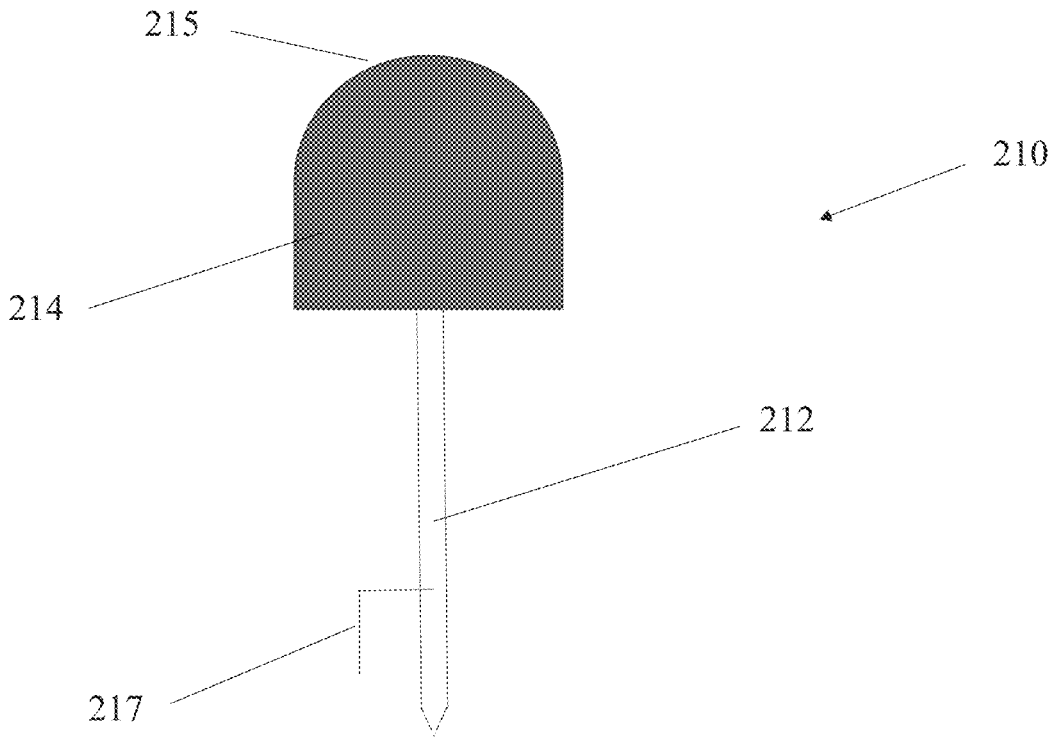
FIG. 8 is a side view of another exemplary temporary, adaptable landscape protection structure.

FIG. 8 illustrates another exemplary structure 210. Similar components may be numbered similarly but increased by one hundred (e.g., 10 to 110, 210). A member 212 may extend to, or be removably attached to, a connector 214. In exemplary embodiments, a bottom portion of the member 212 may form a substantially spiked shaped, such as for insertion into a ground surface. An auxiliary stabilizer 217 may extend from the member 212, such as for insertion into the ground surface to provide stability to the structure 210. The connector 214, in exemplary embodiments without limitation, may comprise a dome shape or otherwise comprise a curved upper surface 215. The upper surface 215 may comprise a relatively high friction material, such as but not limited to rubber, to provide traction to the protective cloth 20 and/or protective covering 22, which may be placed thereatop.

In exemplary embodiments, the member 212 may be configured for telescoping movement to adjust a height of the structure 210. Insertion of the member 212 into the ground surface various distances may, alternatively or additionally, provide height adjustment. A single one, or multiple ones, of the structure 212 may be utilized by themselves or in combination with other ones of the structures 10, 110, 210, 310, 410, and/or 510. The structure 210 may be placed to extend coverage of the protective cloth 20 and/or protective covering 22, protect a particularly sensitive landscape feature(s) 16, such as low-lying flowers or other plants.

Figure 9:
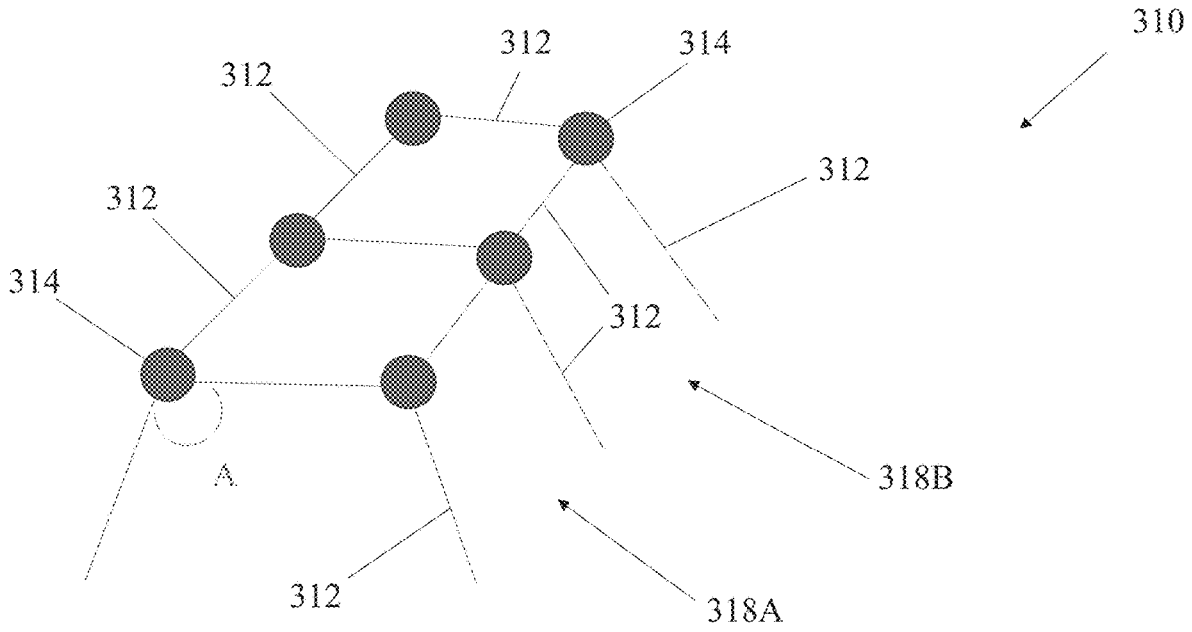
FIG. 9 is a perspective view of another exemplary temporary, adaptable landscape protection structure.

FIG. 9 illustrates another exemplary structure 310. Similar components may be numbered similarly but increased by one hundred (e.g., 10 to 110, 210, 310). The structure 310 may be the same, or similar to, the structure 10, with the members 312 extending at an outward angle to add stability.

In exemplary embodiments, an angle A of between 95° and 145°, such as but not limited to 105°, may be formed between certain of the members 312. In this manner, the structure 310 may form substantially trapezoidal prism shaped spaces 318A-318B. The protective cloth 20 and/or protective covering 22 may be placed over some or all of the structure 310.

Figure 10:
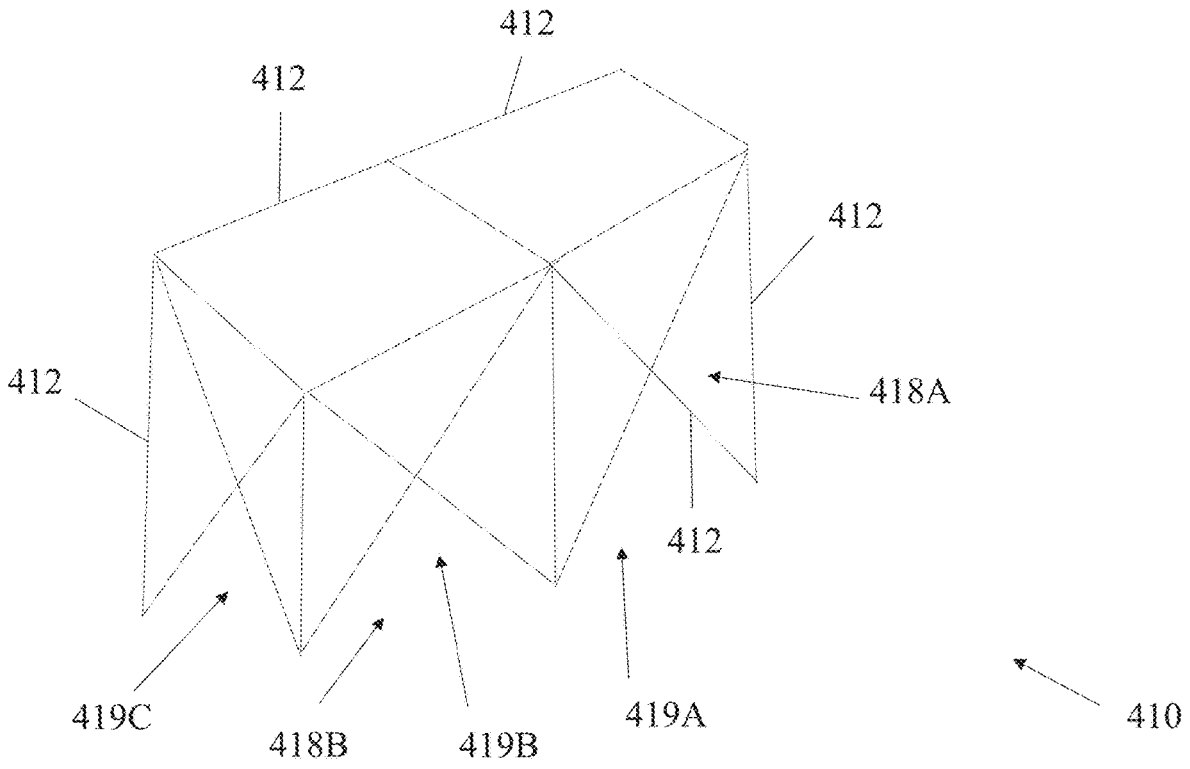
FIG. 10 is a perspective view of another exemplary temporary, adaptable landscape protection structure.

FIG. 10 illustrates another exemplary structure 410. Similar components may be numbered similarly but increased by one hundred (e.g., 10 to 110, 210, 310, 410). The structure 410 may be the same, or similar to, the structure 10, with certain of the members 412 provided as stability substructures 419A-C between other ones of the member 412. In exemplary embodiments, without limitation, each of the stability substructures 419A-C may comprise one or multiple ones of the members 412 extending laterally between various, primarily vertically extending ones of the members 412, such that each of the spaces 418A-B are further defined by such stability substructures 419. The stability substructures 419 may be provided at some of all sides of the structure 410. In exemplary embodiments, without limitation, the stability substructures 419 may comprise two members 412 which cross over one another, such as in a substantial "X" shape, or that connect in such a formation by one or more connectors 414. As another example, the stability substructures 419 may comprise one or more members 412 extending primarily in a horizontal direction. The protective cloth 20 and/or protective covering 22 may be placed over some or all of the structure 410.

Alternatively, or additionally, the stability substructures 419A-C may comprise straps extended between the member 412.

Figure 11:
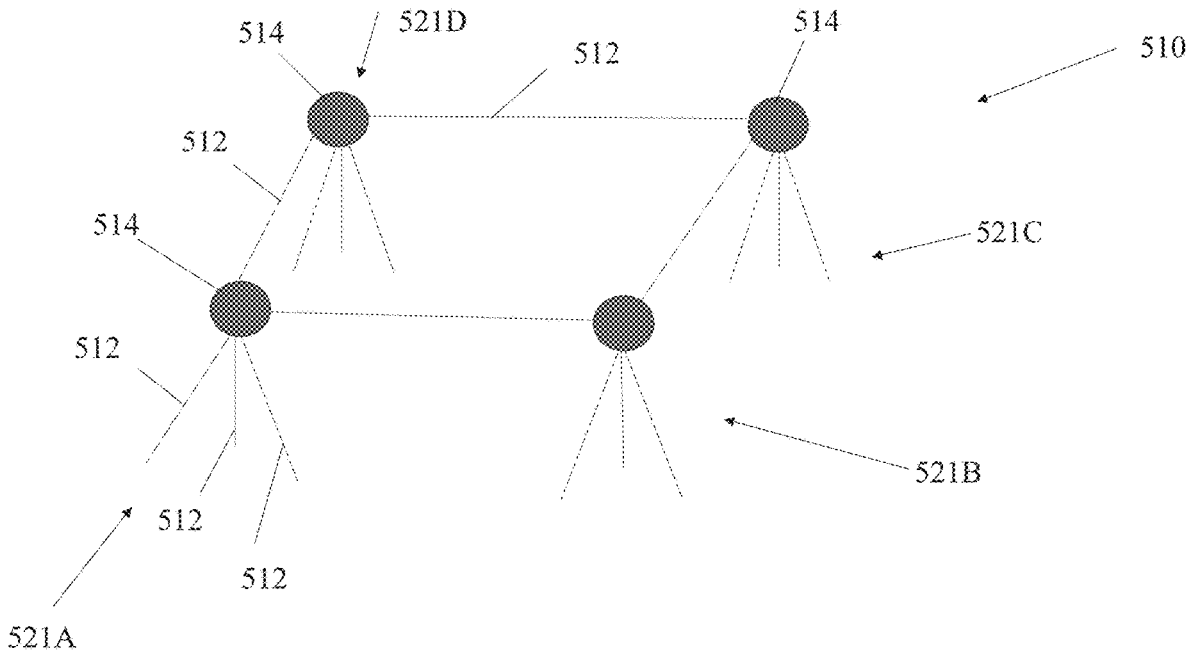
FIG. 11 is a perspective view of another exemplary temporary, adaptable landscape protection structure.
Figure 12:
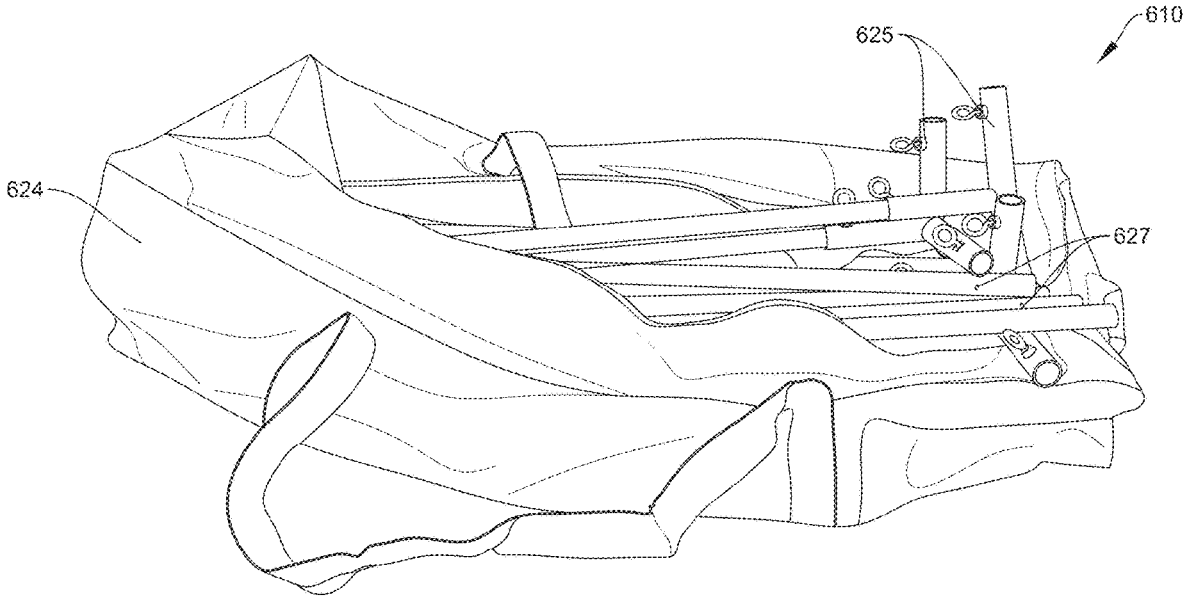
FIG. 12 is a perspective view of a number of constituent components for another exemplary temporary, adaptable landscape protection structure in a disassembled state.

FIG. 11 illustrates another exemplary structure 510. Similar components may be numbered similarly but increased by one hundred (e.g., 10 to 110, 210, 310, 410, 510). The structure 510 may comprise a series of the members 512 arranged into a series of vertical support substructures 521A-D. The vertical support substructures 521A-D, in exemplary embodiments, may each comprise one of the structures 110 and/or multiple members 512 formed into a tri-pod shape by removeable connection with, or integral formation with, a connector 514. Other members 512 may extend between the vertical support substructures 521A-D and/or connectors 514 to create the structure 510. The protective cloth 20 and/or protective covering 22 may be placed over some or all of the structure 510.

FIG. 12 through FIG. 19 illustrate another exemplary embodiment of the structure 610. As illustrated with particular regard to FIG. 12, members 612 and/or the connectors 614 may be fully or partially disassembled for placement within a container 624 for storage. The container 624 may comprise a bag, such as but not limited to a canvas bag, for example without limitation.

Some or all of the connectors 614 may be configured to accept fasteners 625 for securing the members 612 connected thereto, in exemplary embodiments. The fasteners 625 may comprise pins or threaded fasteners, for example. The fasteners 625 may comprise retention screws, set screws, screw eye hooks, machine hooks, combinations thereof, or the like, by way of non-limiting example. The fasteners 625 may be configured for manual adjustment (e.g., tightening and/or loosening), directly and/or by indirectly, such as by inserting a tool (e.g., screwdriver) through the eye hook portion, grasping by tool (e.g., wrench), or the like.

Holes 627 may be provided at some or all of the members 612 to accommodate the fasteners 625. The holes 627 may be threaded or unthreaded. The holes 627 may be positioned to align with the fasteners 625 and/or holes in the connectors 614 for the fasteners 625 when the members 612 are properly inserted into the connectors 614. This may permit securement of the members 612 to the connectors 614 by way of the fasteners 625, for example.

Figure 13:
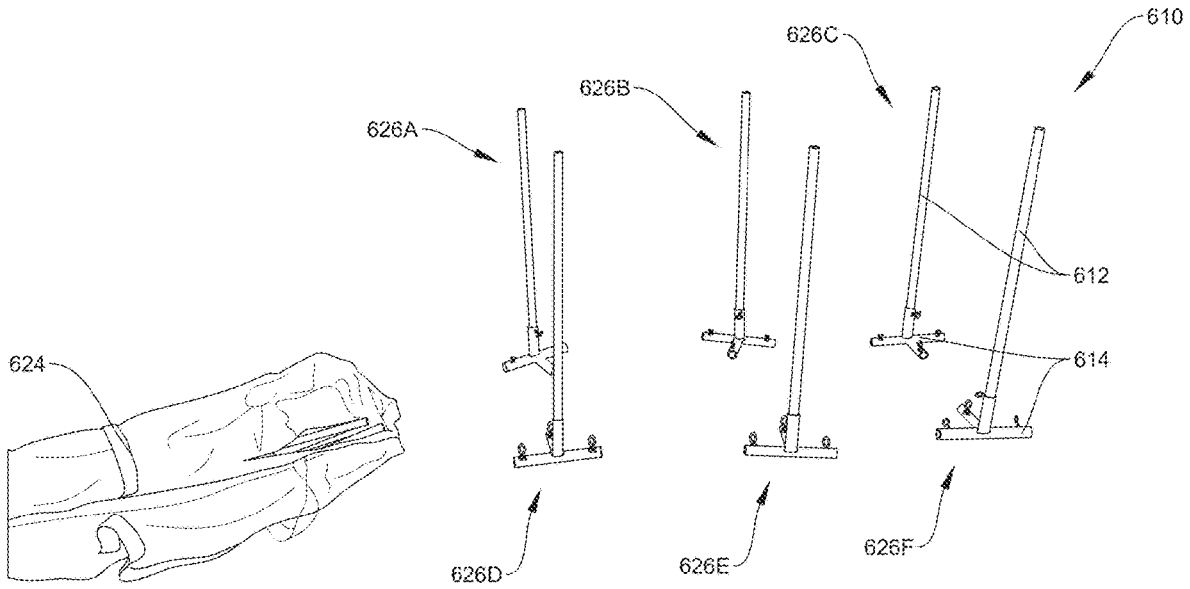
FIG. 13 is a perspective view of the temporary, adaptable landscape protection structure of FIG. 12 in a partially assembled state.
Figure 14:
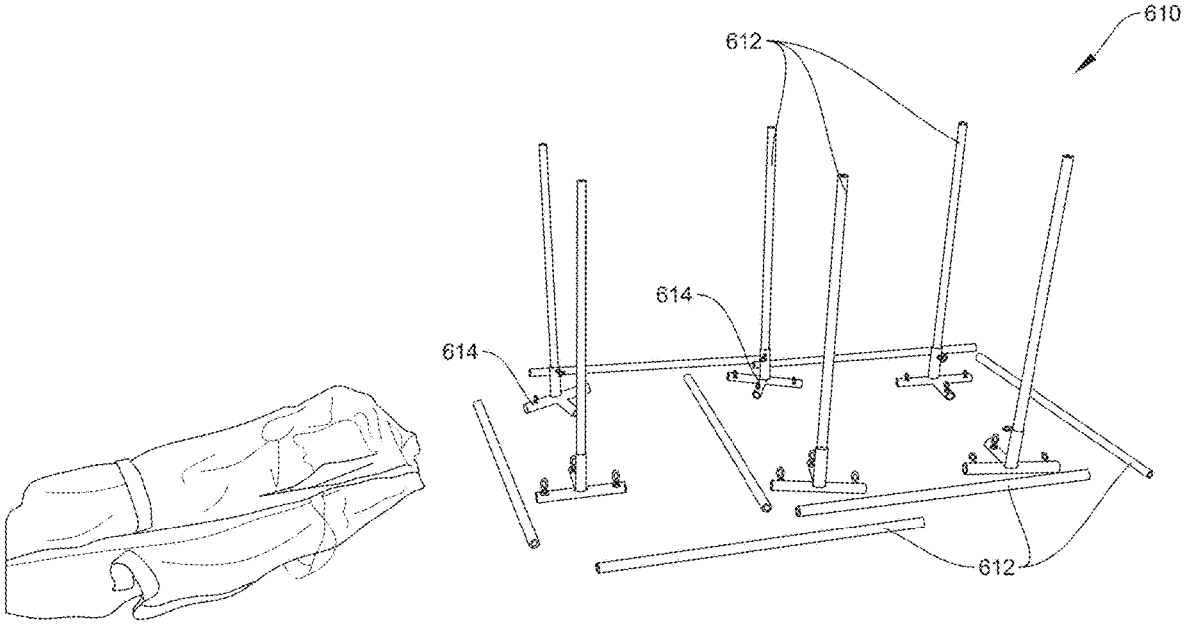
FIG. 14 is a perspective view of the temporary, adaptable landscape protection structure of FIG. 12 in another partially assembled state.

As illustrated with particular regard to FIGS. 13-14, one of the members 612 may be integrally formed with one of the connectors 614, permanently connected, remain connected, and/or be selectively connected to form a subassembly 626. A number of the first subassemblies 626A-F may be provided or assembled as part of creating the structure 610 in exemplary embodiments, without limitation.

Figure 15:
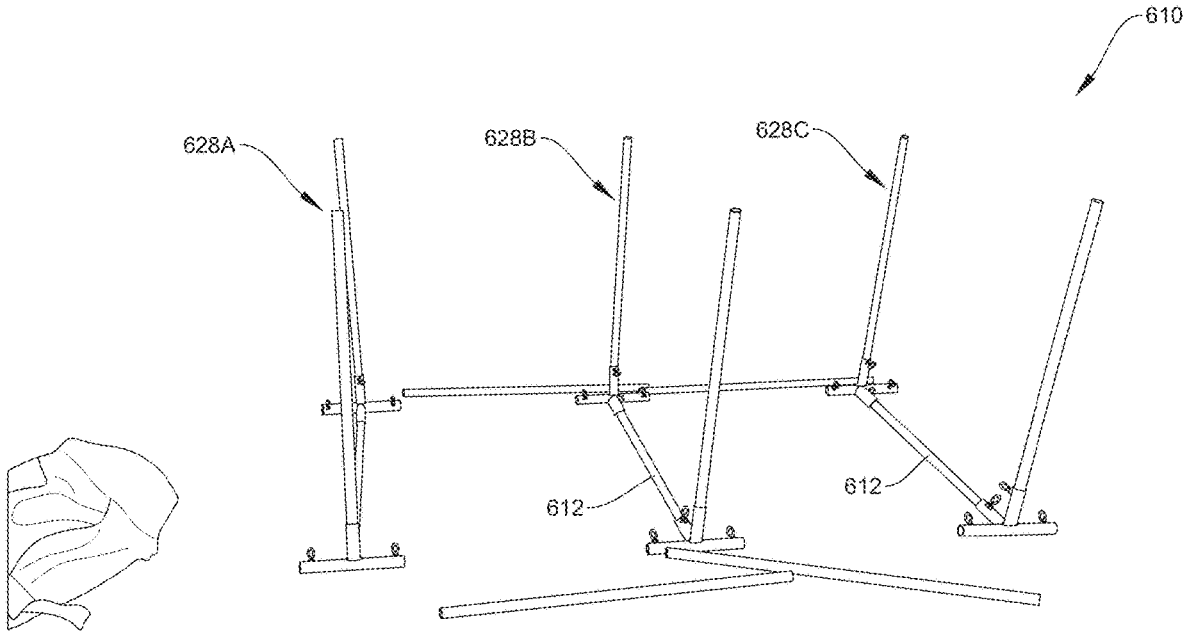
FIG. 15 is a perspective view of the temporary, adaptable landscape protection structure of FIG. 12 in another partially assembled state.

As illustrated with particular regard to FIG. 15, an additional one of the members 612 may be connected between two of the first subassemblies 626 to create a second subassembly 628. A number of the second subassemblies 628A-C may be provided or assembled as part of creating the structure 610 in exemplary embodiments, without limitation.

Figure 16:
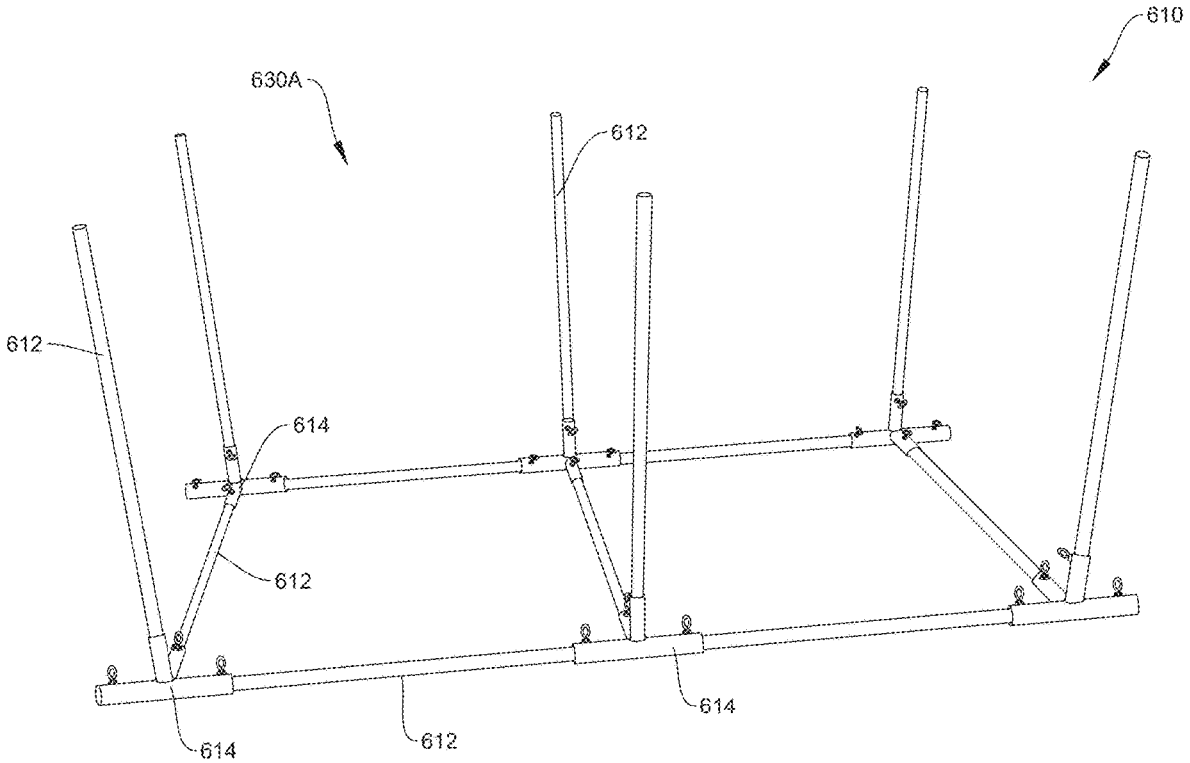
FIG. 16 is a perspective view of the temporary, adaptable landscape protection structure of FIG. 12 in an assembled state.
Figure 17:
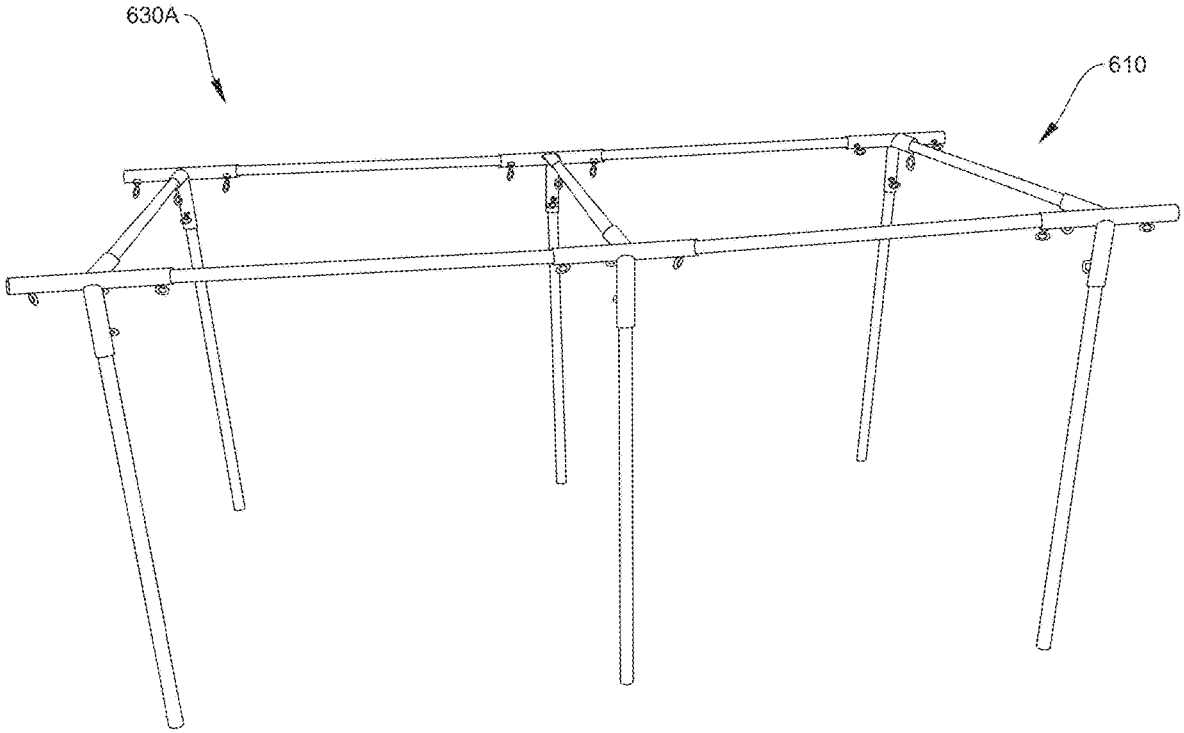
FIG. 17 is a perspective view of the temporary, adaptable landscape protection structure of FIG. 12 in a further assembled state.

As illustrated with particular regard to FIG. 16-17, additional one or ones of the members 612 may be connected between two or more of the second subassemblies 628 to create a third subassembly 630. As shown with particular regard to 18, a number of the third subassemblies 630A-B may be provided or assembled and connected to create the structure 610 in exemplary embodiments, without limitation.

Figure 18:
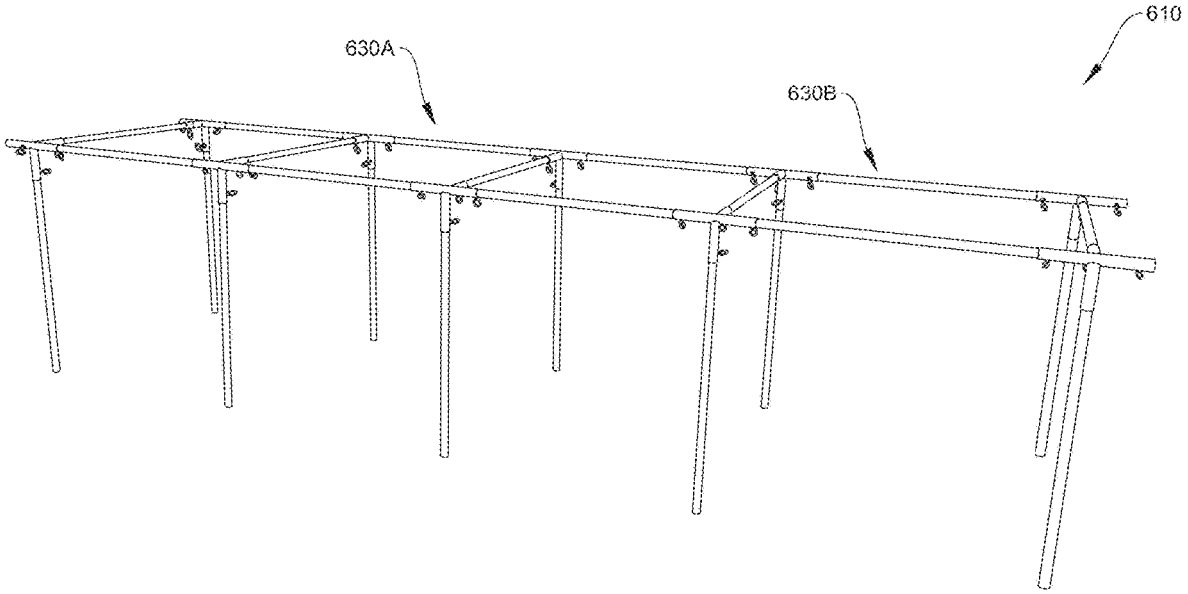
FIG. 18 a perspective view of the temporary, adaptable landscape protection structure of FIG. 12 in another further assembled state.

As illustrated with particular regard to FIG. 18, multiple ones of the third subassemblies 630 may be joined, such as by one or more of the members 612 to one or more of the connectors 614 to create structure 610, for example without limitation. Alternatively, or additionally, any of the first, second, and/or third subassemblies 626, 628, 630 may alone be used for the structure 610. The structure 610 may be any size, shape, or type. The same components may be subsequently disassembled (fully or partially) to create other versions of the structure 610.

Figure 19:
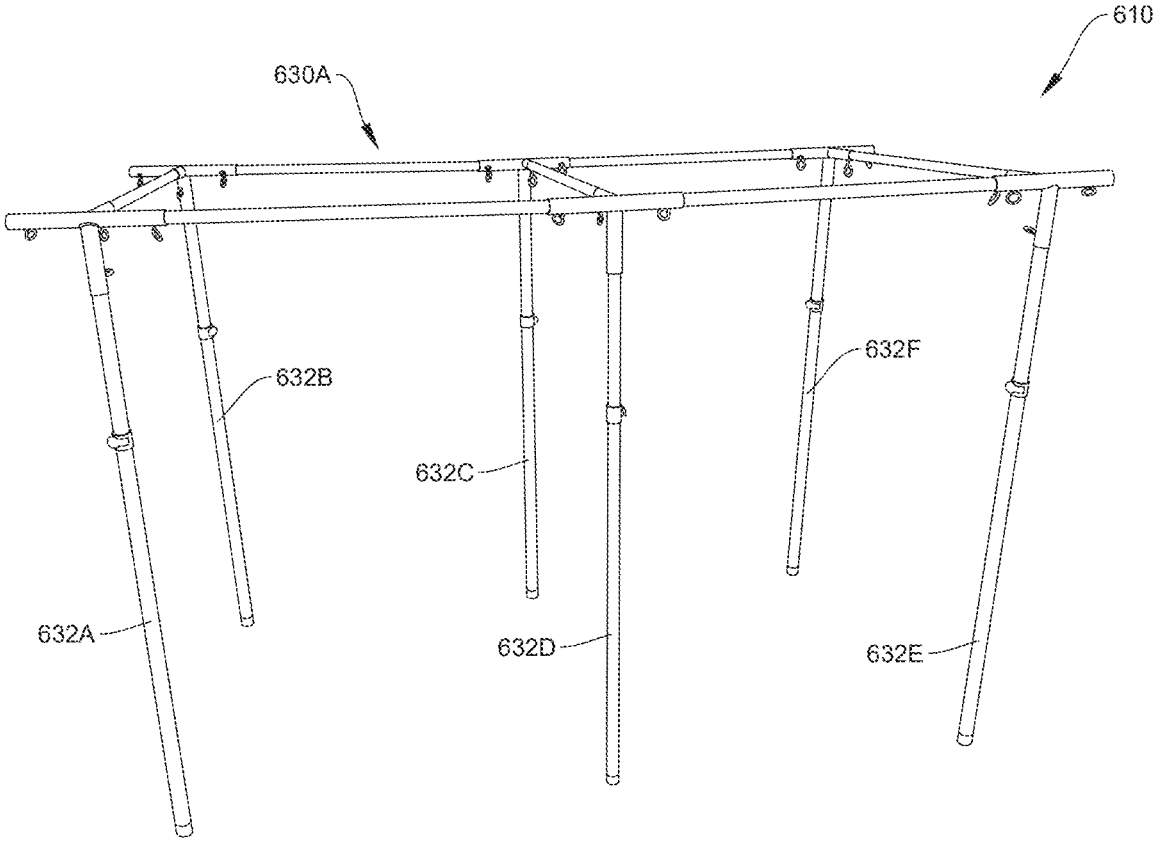
FIG. 19 a perspective view of the temporary, adaptable landscape protection structure of FIG. 12 in another further assembled state.

As illustrated with particular regard to FIG. 19, extension members 632 may be connected to some or all of the members 612. The extension members 632A-F may be configured to telescope along some or all of a respective one of the members 612. The extension members 632 may be configured for sliding movement along an outer surface of the members 612. For example, the members 612 may fit within the extension members 632. The extension members 632 may comprise one or more components, such as collars, pins, holes/fasteners, combinations thereof, or the like for selectively securing the extension members 632 relative to the member 612. In this manner, the height, size, and/or shape of the structure 610 may be at least partially adjustable.

Figure 20:
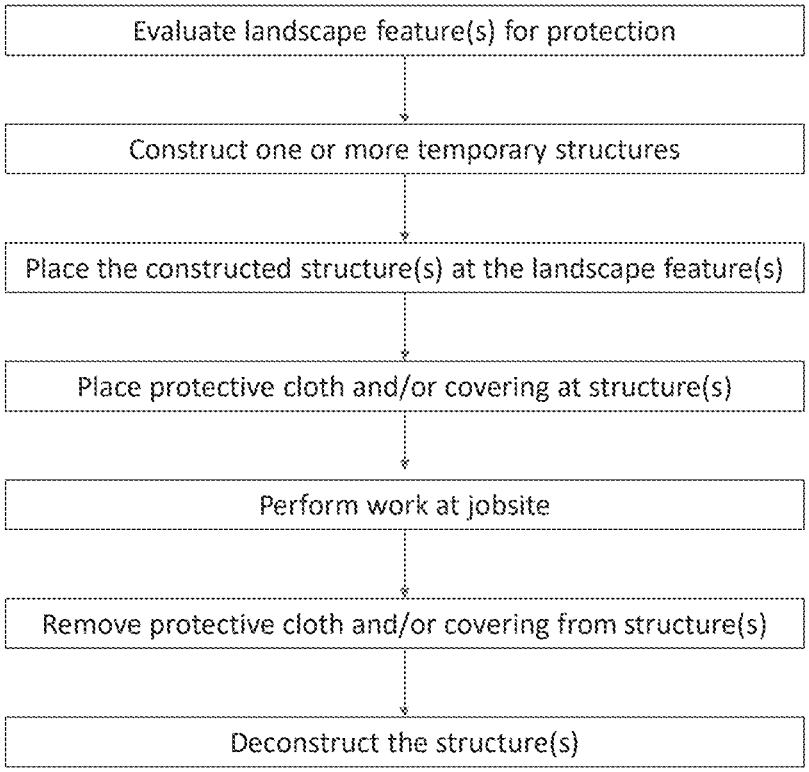
FIG. 20 is a flow chart with an exemplary method for using the temporary, adaptable landscape protection structure(s) of FIGS. 1-19.

FIG. 20 provides an exemplary method for using the structures 10, 110, 210, 310, 410, 510, 610. The landscape features 16 to be protected may be evaluated, such as by manual visual approximation, measurement, combination thereof, or the like. Appropriate ones of the structures 10, 110, 210, 310, 410, 510, 610 may be selected for construction. The structures 10, 110, 210, 310, 410, 510, 610 may be selected based on the size, shape, type, combinations thereof, or the like of the landscape features 16, type of job being performed, type or amount of debris expected, time or expense, material availability, combinations thereof, or the like.

The structures 10, 110, 210, 310, 410, 510, 610 may be constructed and placed at the landscape features 16, such as within, immediately adjacent thereto, spaced apart from, combinations thereof, or the like. The structures 10, 110, 210, 310, 410, 510, 610 may be fully customized or formed into one or more predetermined configurations shown and/or described herein. The structures 10, 110, 210, 310, 410, 510, 610 may be first created, except for the protective cloth 20 and/or protective covering 22, and then placed at the landscape features. Alternatively, or additionally, the structures 10, 110, 210, 310, 410, 510, 610 may be first created, except for the protective cloth 20 and/or protective covering 22, at the landscape features 16. Regardless, the protective cloth 20 and/or protective covering 22 may be then placed over some or all of the structures 10, 110, 210, 310, 410, 510, 610, such as before beginning work. The structure(s) 10, 110, 210, 310, 410, 510, 610 and/or protective cloth 20 and/or covering 22 may serve to absorb and/or transfer forces of falling debris away from the landscaping. Where a covering 22 is used, the structure(s) 10, 110, 210, 310, 410, 510, 610 may also serve as a platform to set tools and/or for work to be accomplished.

The protective cloth 20 and/or protective covering 22 may be subsequently removed, such as when the work is complete. In exemplary embodiments, debris may be folded into, or dumped into, the protective cloth 20 for each collection. The structures 10, 110, 210, 310, 410, 510, 610 may be disassembled, such as for storage or transportation to the next job site.

Alternatively, or additionally, the structures 10, 110, 210, 310, 410, 510, 610 may be moved in a fully or partially assembled state to a next one of the job sites, landscape features 16, or the like.

The structures 10, 110, 210, 310, 410, 510, 610 may be freestanding, thereby reducing any risk of damage to the structure itself.

In exemplary embodiments, the vertically extending members 12, 112, 212, 312, 412, 512, 612 may be placed between or adjacent to individual ones of the landscape features 16 so that the structure(s) 10, 110, 210, 310, 410, 510, 610, and/or the protective covering 22 or protective cloth 20 may extend about the various landscape features 16.

The members 12, 112, 212, 312, 412, 512, 612 may be removably connected to the connectors 14, 114, 214, 314, 414, 514, 614 for creation of various size, shape structures 10, 110, 210, 310, 410, 510, 610 for quick assembly and disassembly. Alternatively, the members 12, 112, 212, 312, 412, 512, 612 and/or connectors 14, 114, 214, 314, 414, 514, 614 may be integrally formed to create the 10, 110, 210, 310, 410, 510, 610, such as with or without the need for the connectors 14, 114, 214, 314, 414, 514, 614.

The structures 10, 110, 210, 310, 410, 510, 610 may be created into various sizes, shapes, configurations, or the like. A single or multiple structures 10, 110, 210, 310, 410, 510, 610 of the same or different type may be utilized. The protective cloth 20 and/or protective covering 22 may be placed over some or all of the structure(s) 10, 110, 210, 310, 410, 510, 610. In this way, the structure(s) 10, 110, 210, 310, 410, 510, 610 may be utilized to protect various size, shape, type, number, or the like landscape features 16, such as on a temporary basis.

The structure(s) 10, 110, 210, 310, 410, 510, 610 may be used by themselves and/or in combination with some or all of the components shown and/or described in the '246 Patent. For example, without limitation, the structure(s) 10, 110, 210, 310, 410, 510, 610 may be erected and placed beneath the chutes of the '246 Patent, which may serve as the protective cloth 20, with or without a separate protective cloth 20 and/or use of the protective covering 22.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Certain operations described herein may be performed by one or more electronic devices. Each electronic device may comprise one or more processors, electronic storage devices, executable software instructions, combinations thereof, and the like configured to perform the operations described herein. The electronic devices may be general purpose computers or specialized computing devices. The electronic devices may comprise personal computers, smartphone, tablets, databases, servers, or the like. The electronic connections and transmissions described herein may be accomplished by wired or wireless means. The computerized hardware, software, components, systems, steps, methods, and/or processes described herein may serve to improve the speed of the computerized hardware, software, systems, steps, methods, and/or processes described herein.

What is claimed is:

1. A method for providing adaptable, reusable, temporary land scape protection at a job site comprising:

constructing temporary structures for landscape features located at the job site;

placing each of the temporary structures over a respective one of landscape features at the job site;

placing sheets of solid material at upper portions of the temporary structures;

placing protective cloths over the temporary structures and the sheets of solid material such that the protective cloths extend over a top and at least two sides of the temporary structures, wherein each of the protective cloths comprise netting with holes;

performing work at the job site;

removing the protective cloths; and deconstructing the temporary structures.

2. The method of claim 1 wherein:

at least one of the temporary structures is different in configuration from another of the temporary structures; and each of the temporary structures is configured to extend over the respective one of the landscape features.

3. The method of claim 2 wherein:

the temporary structures are constructed from a series of standard components comprising: members and connectors.

4. The method of claim 3 wherein:

the members comprise rigid, straight line members; and at least one of the members comprise a stake for placement in the ground.

5. The method of claim 3 wherein:

the members comprise rigid, straight line members; and the connectors comprise apertures configured to receive a portion of at least three of the members at an acute angle relative to one another.

6. The method of claim 3 wherein:

the members comprise rigid, straight line members; and the connectors comprise apertures configured to receive a portion of each of the members at perpendicular angles relative to one another.

7. The method of claim 6 wherein:

each of the connectors comprise at least three apertures with a common origin extending perpendicular relative to each other.

8. The method of claim 1:

wherein the protective cloths each comprises a series of handles located along an outer perimeter of the netting; and further comprising:

depositing debris at the protective cloths during performance of a job at the job site;

folding the protective cloths to capture the deposited debris; and disposing of the deposited debris.

9. The method of claim 8 wherein:

the job is a roof replacement or repair;

the job site is a residence or commercial property;

the temporary structures are constructed at the job site;

the holes have a diameter not exceeding 0.25 inches;

the netting is configured to capture shingles dropped from a height of at least 20 feet; and the solid material comprises plywood.

10. The method of claim 3 further comprising:

constructing a second set of temporary structures configured to extend over landscape features of a second job site from the members and connectors, said second set of temporary structures being different in at least one of size, shape, and composition from the temporary structures;

placing the second set of temporary structures over the landscape features at the second job site;

placing the protective cloths over the second set of temporary structures;

performing a job at the second job site;

removing the protective cloths from the second set of temporary structures; and deconstructing the second set of temporary structures for removal from the second job site.

11. A method for providing adaptable, reusable, temporary landscape protection at a job site comprising:

evaluating landscape features at the job site for protection;

selecting a subset of the landscape features for added protection;

constructing temporary structures at the job site configured to extend over the subset of the landscape features, said temporary structures comprising rigid straight-line members and connectors with apertures configured to receive and temporarily secure the members relative to one another, wherein at least one of the temporary structures is different in configuration from another one of the temporary structures;

placing the temporary structures over the subset of the landscape features;

placing plywood sheets at upper surfaces of the temporary structures;

placing protective cloths comprising netting and handles located about a perimeter of the netting over the plywood sheets;

performing a roof replacement at the job site, including depositing roofing debris at the protective cloths;

folding the cloths to capture the deposited roofing debris;

removing the folded cloths from the temporary structures; and deconstructing the temporary structures for removal from the job site.

12. The method of claim 11 further comprising:

evaluating landscape features at a second job site for protection;

selecting a subset of the landscape features at the second job site for added protection;

constructing a second set of temporary structures at the second job site configured to extend over the subset of the landscape features of the second job site from the members and connectors, at least some of said second set of temporary structures being different in at least one of size, shape, and composition from the temporary structures, wherein at least one of said second set of temporary structures is different in configuration from another one of said second set of temporary structures;

placing the second set of temporary structures over the subset of the landscape features at the second job site;

placing the plywood sheets over upper surfaces of the second set of temporary structures;

placing the protective cloths over the plywood sheets at the second set of temporary structures;

performing a roof replacement at the second job site, including depositing roofing debris at the protective cloths;

folding the cloths to capture the deposited roofing debris;

removing the folded cloths from the second set of temporary structures; and deconstructing the second set of temporary structures for removal from the second job site.

13. The method of claim 12 wherein:

each of said second set of temporary structures is different in all of size, shape, and composition from each of the temporary structures.

14. The method of claim 12 wherein:

the subset comprises some, but not all, of the landscape features.

15. A method for providing adaptable, reusable, temporary landscape protection at a job site comprising:

constructing temporary structures for landscape features located at the job site;

placing each of the temporary structures over a respective one of landscape features at the job site;

placing sheets of solid material only at upper portions of the temporary structures;

placing protective cloths over the temporary structures and sheets of solid material, wherein the protective cloths each comprises a netting and a series of handles located along an outer perimeter of the netting;

performing work at the job site, including depositing debris at the protective cloths;

removing the protective cloths, including folding the protective cloths to capture the deposited debris;

disposing of the depositing debris; and deconstructing the temporary structures.

16. The method of claim 15 wherein:

the step of placing the protective clothes over the temporary structure comprises placing the protective cloths such that the protective cloths extend over a top and at least partially along at least two sides of the temporary structures; and each of the protective cloths comprise netting with holes.

17. The method of claim 16 wherein:
the job is a roof replacement or repair;
the job site is a residence or commercial property;
the temporary structures are constructed at the job site;
the holes have a diameter not exceeding 0.25 inches;
the netting is configured to capture shingles dropped from a height of at least 20 feet; and
the solid material comprises plywood.

* * * * *